US008777344B2

(12) United States Patent
Ito

(10) Patent No.: US 8,777,344 B2
(45) Date of Patent: Jul. 15, 2014

(54) LIQUID EJECTION APPARATUS

(75) Inventor: Takashi Ito, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 176 days.

(21) Appl. No.: 13/429,746

(22) Filed: Mar. 26, 2012

(65) Prior Publication Data

US 2013/0033533 A1 Feb. 7, 2013

(30) Foreign Application Priority Data

Aug. 4, 2011 (JP) ..... 2011-171100

(51) Int. Cl.
*B41J 29/38* (2006.01)

(52) U.S. Cl.
USPC ..... 347/9

(58) Field of Classification Search
USPC ..... 347/9, 21, 22, 28, 29, 32–34
IPC ..... B41J 29/38
See application file for complete search history.

(56) References Cited

U.S. PATENT DOCUMENTS

2005/0128242 A1* 6/2005 Suzuki ..... 347/29
2007/0229611 A1* 10/2007 Nagashima ..... 347/84
2007/0257956 A1* 11/2007 Akase et al. ..... 347/29
2009/0033707 A1* 2/2009 Shimazaki ..... 347/29
2009/0109257 A1* 4/2009 Shimazaki ..... 347/31
2009/0167815 A1* 7/2009 Ito ..... 347/32
2009/0195593 A1* 8/2009 Iwanaga ..... 347/32
2009/0303282 A1* 12/2009 Yamamoto ..... 347/32
2010/0171789 A1* 7/2010 Mun et al. ..... 347/31
2011/0050768 A1* 3/2011 Itogawa ..... 347/9

FOREIGN PATENT DOCUMENTS

JP 2001-018408 A 1/2001
JP 2005-212138 A 8/2005
JP 2006-062166 A 3/2006

* cited by examiner

*Primary Examiner* — Manish S Shah
*Assistant Examiner* — Roger W Pisha, II
(74) *Attorney, Agent, or Firm* — Baker Botts L.L.P.

(57) ABSTRACT

A liquid ejection apparatus includes a head for ejecting liquid, a cap unit for sealing an ejection surface of the head, a humidified air supply mechanism including a storing part for storing humidifying liquid and for performing a humidifying operation, a discharge unit discharges liquid from the head, a control unit for controlling the humidifying operation and a liquid discharge operation, and a detection unit for detecting whether the humidifying liquid is stored in the storing part. When the detection unit detects that no humidifying liquid is stored in the storing part, the control unit controls the discharge unit such that a liquid discharge amount from the head in the liquid discharge operation is larger than that of a case where the detection unit detects that the humidifying liquid is stored in the storing part.

9 Claims, 10 Drawing Sheets

⊗⟶ MAIN SCANNING DIRECTION

SUB-SCANNING DIRECTION

LIQUID EJECTION APPARATUS

CROSS-REFERENCE TO RELATED APPLICATION

This application claims priority from Japanese Patent Application No. 2011-171100, filed on Aug. 4, 2011, the entire subject matter of which is incorporated herein by reference.

TECHNICAL FIELD

Aspects of the present invention relate to a liquid ejection apparatus which ejects liquid.

BACKGROUND

A liquid ejection apparatus includes a head having an ejection surface formed with opened ejection ports for ejecting liquid such as ink. If the liquid is not ejected from the ejection ports for a long time, water content of the liquid in the vicinity of the ejection ports is evaporated to increase viscosity, so that the ejection ports are clogged. There has been known a technique for suppressing such clogging of the ejection ports.

According to that technique, the ejection surface is covered by a capping part having a recessed shape, so that an ejection space isolated from an exterior space is formed. While humidified air is supplied from an air supply port to the ejection space by an air conditioning system including an air flow path having the air supply port and an air discharge port formed on a bottom surface of the capping part, the air in the ejection space is discharged from the air discharge port, so that the liquid in the vicinity of the ejection ports is humidified. Accordingly, the drying of the liquid in the vicinity of the ejection ports is suppressed, so that the clogging of the ejection ports is suppressed.

However, according to that technique, if the air conditioning system adjusts the humidity of the humidified air by using a humidifying liquid, for example, it is not possible to adjust the humidity of the air when the humidifying liquid is exhausted. At this state, when air whose humidity is not adjusted is supplied into the ejection space, the water content of the liquid in the vicinity of the ejection ports is evaporated to increase the viscosity. That is, the ejection ports are clogged, thereby causing a problem of ejection defect.

SUMMARY

Accordingly, an aspect of the present invention provides a liquid ejection apparatus capable of restoring a liquid ejection capability from ejection ports even when there remains no humidifying liquid.

According to an illustrative embodiment of the present invention, there is provided a liquid ejection apparatus including a liquid ejection head, a cap unit, a humidified air supply mechanism, a discharge unit, a control unit and a detection unit. The liquid ejection head includes ejection ports for ejecting liquid. The cap unit is configured to take a sealed state where an ejection space facing the ejection ports is sealed from an exterior space and a non-sealed state where the ejection space is opened to the exterior space. The humidified air supply mechanism includes a storing part configured to store humidifying liquid for generating humidified air, and is configured to perform a humidifying operation of generating humidified air and supplying the humidified air into the ejection space at the sealed state. The discharge unit is configured to discharge liquid from the ejection ports. The control unit is configured to control the humidified air supply mechanism to perform the humidifying operation after controlling the cap unit to take the sealed state, and is configured to control the discharge unit to perform a liquid discharge operation of discharging liquid from the ejection ports after controlling the cap unit to take the non-sealed state in response to receiving a printing command at a standby state after the humidifying operation. The detection unit is configured to detect whether the humidifying liquid is stored in the storing part. After the cap unit takes the sealed state and until the humidified air supply mechanism starts the humidifying operation, when the detection unit detects that no humidifying liquid is stored in the storing part, the control unit is configured to control the discharge unit such that a liquid discharge amount from the ejection ports in the liquid discharge operation is larger than that of a case where the detection unit detects that the humidifying liquid is stored in the storing part.

According to the above configuration, even when the humidifying operation is performed in a state where the remains no humidifying liquid, it is possible to restore the liquid ejection capability from the ejection ports. Accordingly, it is possible to keep a quality of an image formed based on a printing command.

BRIEF DESCRIPTION OF THE DRAWINGS

The above and other aspects of the present invention will become more apparent and more readily appreciated from the following description of illustrative embodiments of the present invention taken in conjunction with the attached drawings, in which.

DETAILED DESCRIPTION

Hereinafter, illustrative embodiments of the present invention will be described with reference to the accompanied drawings.

Figure 1:
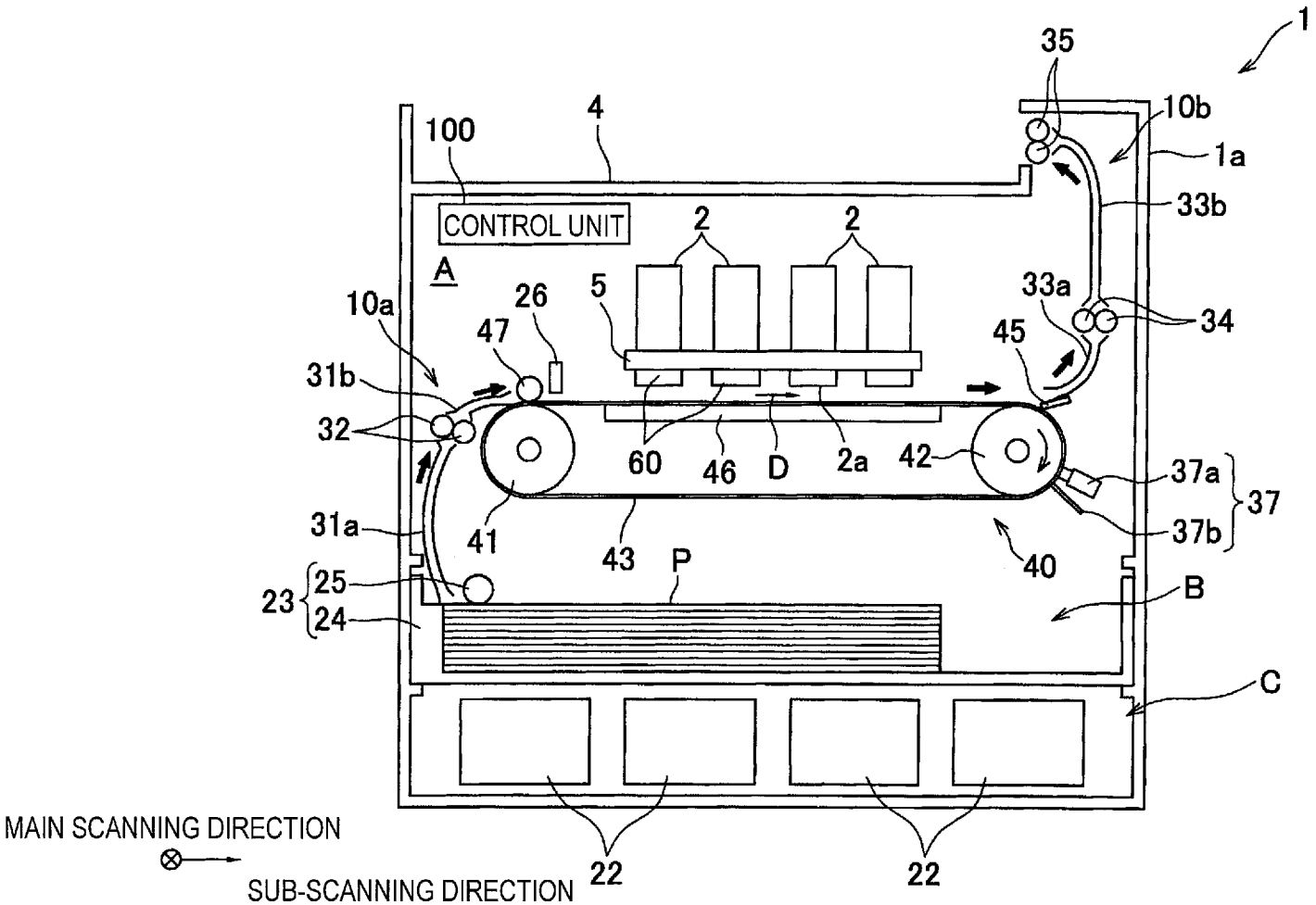
FIG. 1 is a schematic side view showing an interior configuration of an inkjet printer according to an illustrative embodiment of the present invention.

First, an overall configuration of an inkjet printer 1 (an example of a liquid ejection apparatus) is described with reference to FIG. 1.

The printer 1 includes a housing 1*a* having a rectangular parallelepiped shape. An upper part of a top plate of the housing 1*a* is provided with a sheet discharge part 4. An interior space of the housing 1*a* can be divided into spaces A, B and C in order from the above. In the spaces A, B, a sheet conveyance path from a feeder unit 23 toward the sheet discharge part 4 is formed, and a sheet P is conveyed along a thick arrow shown in FIG. 1. In the space A, an image is formed on the sheet P and the sheet P is conveyed toward the sheet discharge part 4. In the space B, the sheet P is fed toward the conveyance path. In the space C, ink is supplied to inkjet heads 2 in the space A.

In the space A, there are provided four inkjet heads 2 (hereinafter, referred to as heads 2), a conveyance mechanism 40, two guide parts 10*a*, 10*b* which guide the sheet P, a humidified air supply mechanism 50 (refer to FIG. 6) which is used in a humidifying maintenance, a head lifting mechanism 33 (refer to FIG. 8), a wiper unit 36 (refer to FIG. 8), a cleaner unit 37, a buzzer 27 (refer to FIG. 8), a temperature sensor 28 (refer to FIG. 8), a humidity sensor 29 (refer to FIG. 8), a control unit 100 and the like. The temperature sensor 28 and the humidity sensor 29 are disposed in the vicinity of the heads 2 and output signals for indicating detected temperature and humidity to the control unit 100, respectively. Also, the buzzer 27 is arranged adjacent to the control unit 100.

The four heads 2 eject any one ink droplets of magenta, yellow, cyan and black. Each of the four heads 2 has a substantially rectangular parallelepiped shape which is long in a main scanning direction. Also, the four heads 2 are arranged at a predetermined interval in a sub-scanning direction and are supported to the housing 1*a* via a head holder 5. By the head holder 5, a predetermined gap appropriate for printing is formed between lower surfaces of the heads 2 and a conveyance belt 43 (conveyance mechanism 40).

Each head 2 is a laminated body including actuator units 21, a reservoir unit, a flexible printed circuit (FPC) board, a control substrate and the like laminated in addition to the head body 3. A lower surface of the head body 3 (flow path unit 9) is an ejection surface 2*a* on which ejection ports 108 are opened. A signal adjusted in the control substrate is converted into a driving signal in a driver IC on the FPC, which is then output to the actuator units 21. When the actuator units 21 are driven, the ink supplied from the reservoir unit is ejected from the ejection ports 108.

Caps 60 configuring the humidified air supply mechanism 50 are attached to the head holder 5. The cap 60 is an annular member which is provided to each head 2, and involves the head 2, when seen from a plan view. A configuration, an operation, a function and the like of the cap 60 will be specifically described later.

The head lifting mechanism 33 lifts the head holder 5 up and down, so that the four heads 2 are moved between a printing position and a retraction position. At the printing position, the four heads 2 face the conveyance belt 43 at an interval appropriate for printing. At the retraction position, the four heads 2 are spaced from the conveyance belt 43 at an interval beyond the printing position. At the retraction position, the wiper unit 36 can move in a space between the four heads 2 and the conveyance belt 43.

Figure 10A:
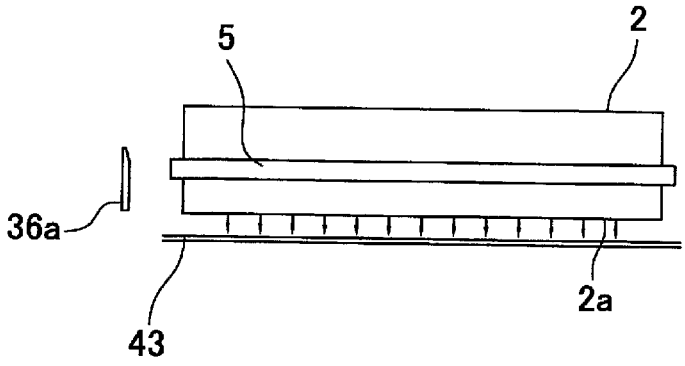
FIGS. 10A and 10B are views showing a wiping operation.
Figure 10B:
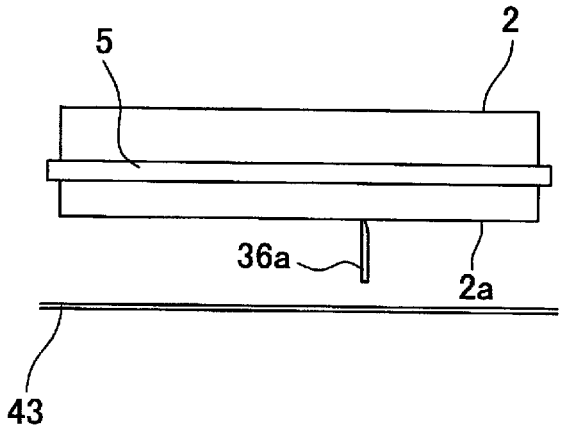

The wiper unit 36 has four wipers 36*a* (refer to FIG. 10) and wipes the respective ejection surfaces 2*a*. The wiper 36*a* is a plate-shaped elastic member of rubber, for example. In FIGS. 10A and 10B, only one wiper 36*a* is shown. The wiper unit 36 wipes the ejection surfaces 2*a* by moving the wipers 36*a* along the main scanning direction while bringing the wipers 36*a* contact with the ejection surfaces 2*a* of the heads 2.

The cleaner unit 37 has a cleaning liquid applying member 37*a*, a blade 37*b* and a moving mechanism 37*c* (refer to FIG. 8) for moving the cleaning liquid applying member 37*a* and the blade 37*b* and cleans an outer periphery of the conveyance belt 43. As shown in FIG. 1, the cleaner unit 37 is arranged at a right and lower part of the conveyance belt 43 while facing a belt roller 42. The cleaning liquid applying member 37*a* has a porous member (for example, sponge) and a support member which supports the porous member, and the blade 37*b* is configured by a plate-shaped elastic member (for example, rubber). Both of them are configured to contact the conveyance belt 43 over its full width. In a cleaning operation which will be described later, the moving mechanism 37*c* brings the cleaning liquid applying member 37*a* and the blade 37*b* contact the outer periphery of the conveyance belt 43. When the conveyance belt 43 travels, a cleaning liquid is applied from the porous member to the outer periphery and the applied cleaning liquid is scraped by the downstream blade 37*b* together with foreign matters on the outer periphery.

The conveyance mechanism 40 has two belt rollers 41, 42, the conveyance belt 43, a platen 46, a nip roller 47 and a separation plate 45. The conveyance belt 43 is an endless belt which is wound around the belt rollers 41, 42. The platen 46 is arranged to face the four heads 2 and supports an upper loop of the conveyance belt 43 from an inner side thereof. The belt roller 42 is a driving roller and moves the conveyance belt 43. The belt roller 42 is rotated in a clockwise direction in FIG. 1 by a motor (not shown). The belt roller 41 is a driven roller and is rotated as the conveyance belt 43 travels. The outer periphery of the conveyance belt 43 is formed with a weak adhesive silicon layer. The nip roller 47 presses the sheet P, which is conveyed from the feeder unit 23, to the outer periphery of the conveyance belt 43. The sheet P is kept on the conveyance belt 43 by the silicon layer and is conveyed toward the heads 2. The separation plate 45 separates the conveyed sheet P from the conveyance belt 43 and guides the same to the downstream sheet discharge part 4.

The two guide parts 10*a*, 10*b* are arranged with the conveyance mechanism 40 being interposed therebetween. The upstream guide part 10*a* with respect to the conveyance direction has two guides 31*a*, 31*b* and a pair of conveyance rollers 32 and connects the feeder unit 23 and the conveyance mechanism 40. The sheet P for image formation is conveyed toward the conveyance mechanism 40. The downstream guide part 10*b* with respect to the conveyance direction has two guides 33*a*, 33*b* and two pairs of conveyance rollers 34, 35 and connects the conveyance mechanism 40 and the sheet discharge part 4. The sheet P having an image formed thereon is conveyed toward the sheet discharge part 4.

In the space B, the feeder unit 23 is arranged. The feeder unit 23 has a sheet feeding tray 24 and a sheet feeding roller 25. The sheet feeding tray 24 is detachably mounted to the housing 1*a*. The sheet feeding tray 24 is a box which is opened upward and can accommodate a plurality of sheets P therein. The sheet feeding roller 24 feeds the uppermost sheet P in the sheet feeding tray 24.

Here, the sub-scanning direction is a direction parallel with a conveyance direction D of the sheet which is conveyed by the conveyance mechanism 40. The main scanning direction is a direction parallel with a horizontal surface and orthogonal to the sub-scanning direction.

In the space C, four cartridges 22 storing inks are detachably mounted to the housing 1*a*. The four cartridges 22 store therein magenta, yellow, cyan and black inks and are connected to the corresponding heads 2 via tubes (not shown) and pumps 38 (refer to FIG. 8). In the meantime, each pump 38 (an example of a forcible discharge unit: a part of the discharge unit) is driven by the control unit 100 when it forcibly pumps the ink to the head 2 (i.e., when a purge operation or initial introduction of liquid is performed). Except for this, the respective pumps 38 are at a dormant state and do not interfere with the ink supply to the heads 2.

In the below, the control unit 100 is described. The control unit 100 controls the operations of the respective units of the printer 1, thereby controlling the overall operation of the printer 1. Based on a printing command input from an external apparatus (PC connected to the printer 1, for example), the control unit 100 controls an image formation operation. Specifically, the control unit 100 controls a conveyance operation of the sheet P, an ink ejection operation in accordance with the conveyance of the sheet P, and the like.

Based on the printing command received from the external apparatus, the control unit 100 drives the feeder unit 23, the conveyance mechanism 40 and the pairs of conveyance rollers 32, 34, 35. The sheet P fed from the sheet feeding tray 24 is guided by the upstream guide part 10*a* and is sent to the conveyance mechanism 40. When the sheet P conveyed by the conveyance mechanism 40 passes immediately below the heads 2, the heads 2 are controlled by the control unit 100, so that the ink droplets are sequentially ejected from the respective heads 2. Thereby, a desired color image is formed on a surface of the sheet P. The ink ejection operation is based on a detection signal from a sheet sensor 26. The sheet sensor 26 is arranged at a more upstream position than the heads 2 with respect to the conveyance direction D, and detects a leading end of the sheet P. An ink ejection timing is determined by the detection signal. The sheet P having an image formed thereon is separated from the conveyance belt 43 by the separation plate 45, is guided by the downstream guide part 10*b* and is then discharged to the sheet discharge part 4 from the upper part of the housing 1*a*.

The control unit 100 also controls a maintenance operation of restoring the ink ejection characteristics of the heads 2. In the maintenance operation, the control unit 100 makes preparation for restoring/keeping the ink ejection characteristics of the heads 2 and for recording of the heads 2. The maintenance operation includes a purge or flushing operation, the wiping operation for the ejection surfaces 2*a*, the cleaning operation for the conveyance belt 43, a viscosity increase preventing operation for ink by capping or humidification, and the like.

In the purge operation, the pumps 38 are driven to forcibly discharge the inks from all the ejection ports 108. At this time, the actuators are not driven. The flushing operation includes a discharge flushing and a non-discharge flushing. In the discharge flushing, the actuators are driven to discharge the inks from all the ejection ports 108. In the non-discharge flushing, the actuators are driven to vibrate ink menisci formed in the ejection ports 108 without discharging the ink from the ejection ports 108. The discharge flushing is performed based on discharge flushing data (data different from the image data). The non-discharge flushing is also performed based on non-discharge flushing data. In the wiping operation, the ejection surfaces 2*a* are wiped by the wipers 36*a* (refer to FIGS. 10A and 10B). The wiping operation is performed after the purge operation and removes the remaining ink or foreign matters on the ejection surfaces 2*a*. Also, in the cleaning operation, the conveyance belt 43 is cleaned by the cleaner unit 37. The cleaning operation is performed after the purge and discharge flushing operations, and removes the remaining ink or foreign matters on the conveyance belt 43.

Figure 6:
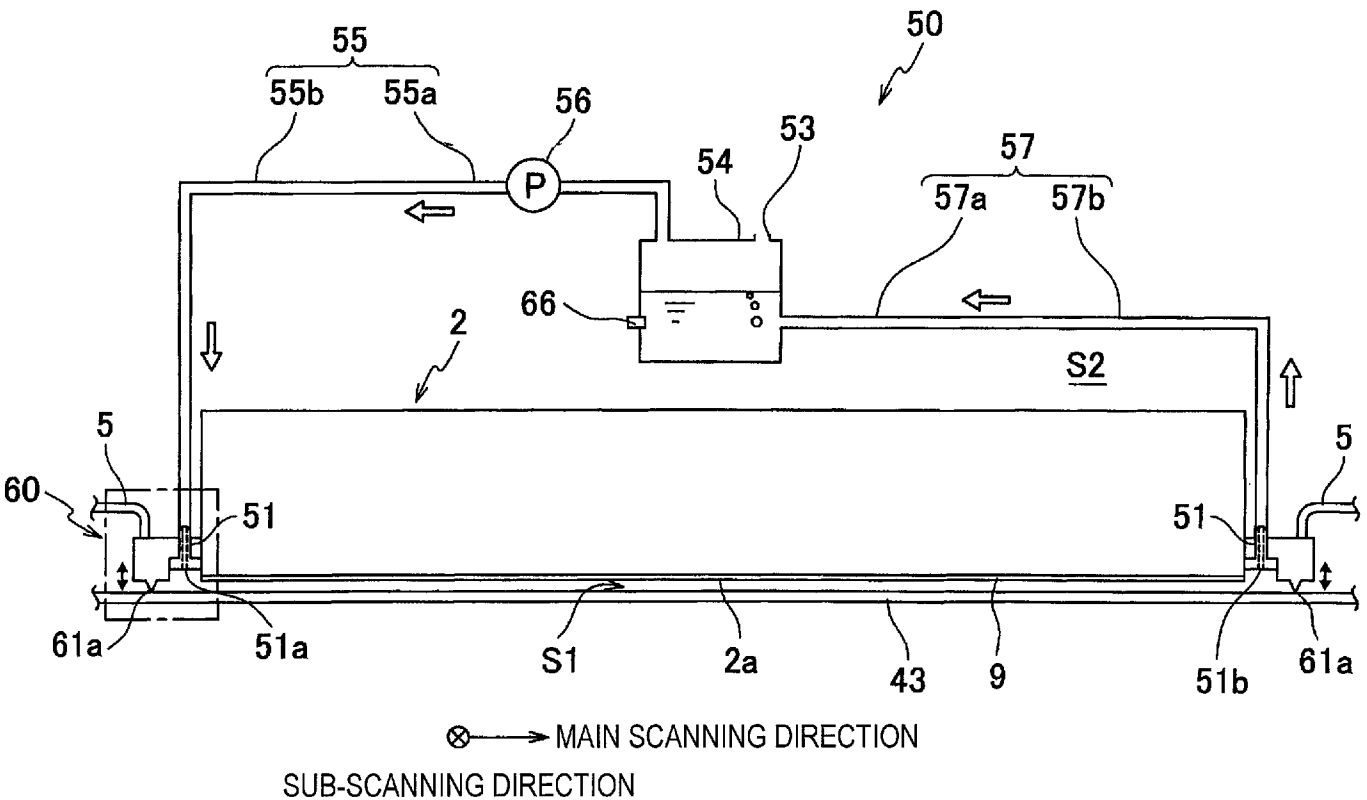
FIG. 6 is a schematic view showing a head holder and a humidified air supply mechanism which are included in the printer of FIG. 1.

As shown in FIG. 6, in the capping, an ejection space (a space facing the ejection surfaces 2*a* (ejection ports 108)) S1 is isolated from an exterior space S2 by the caps 60. In the humidifying operation (humidifying maintenance), as shown in FIG. 6, the humidified air is supplied into the isolated ejection space S1. By the capping, the water vapor is stored in the ejection space S1 and the drying is suppressed by the humidification.

In the below, the head body 3 of the head 2 is specifically described with reference to FIGS. 2 to 5. In FIG. 3, pressure chambers 110, apertures 112 and ejection ports 108 that are below the actuator units 21 and should be thus shown with the dotted lines are shown with the solid lines for convenience of explanations.

Figure 2:
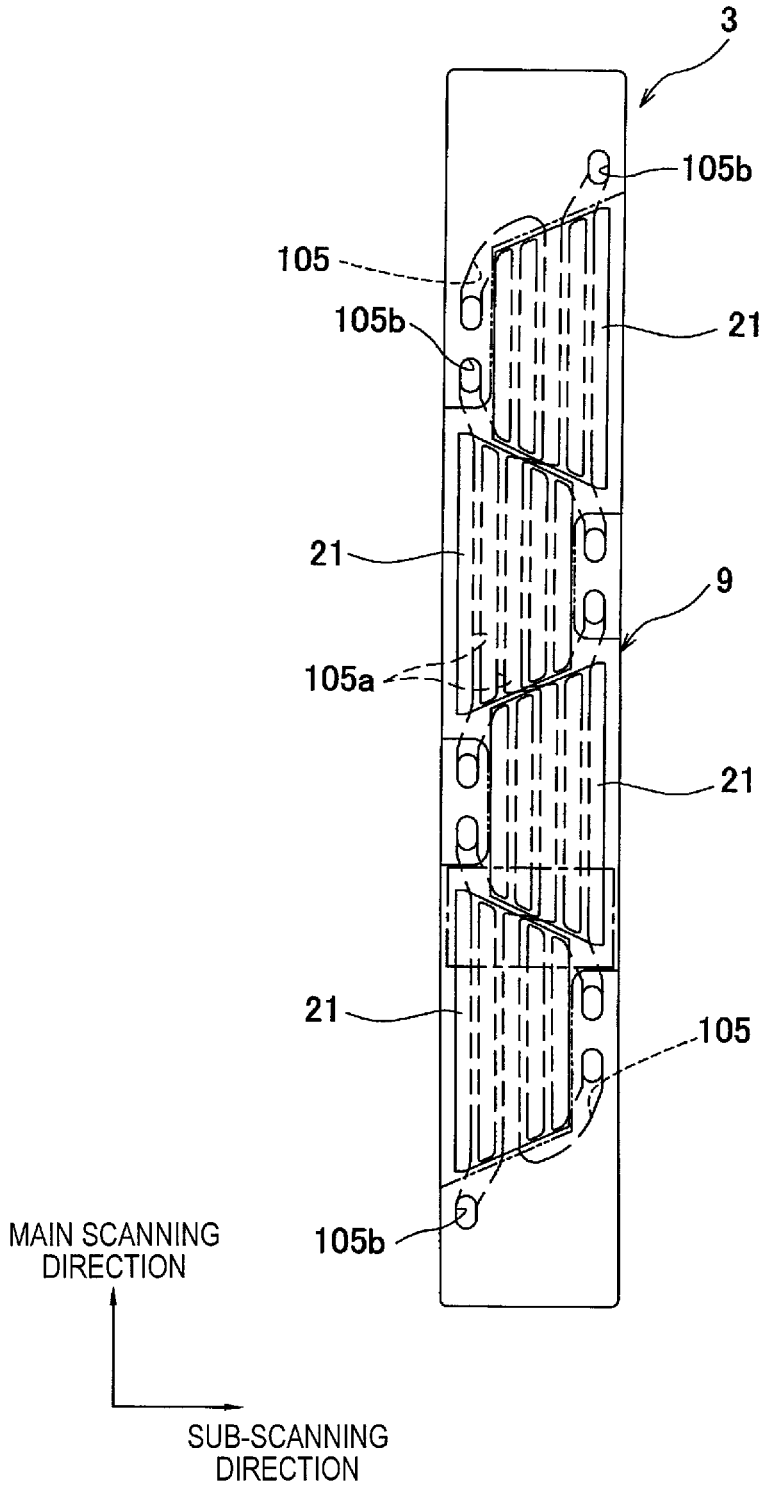
FIG. 2 is a plan view showing a head body of an inkjet head which is included in the printer of FIG. 1.
Figure 3:
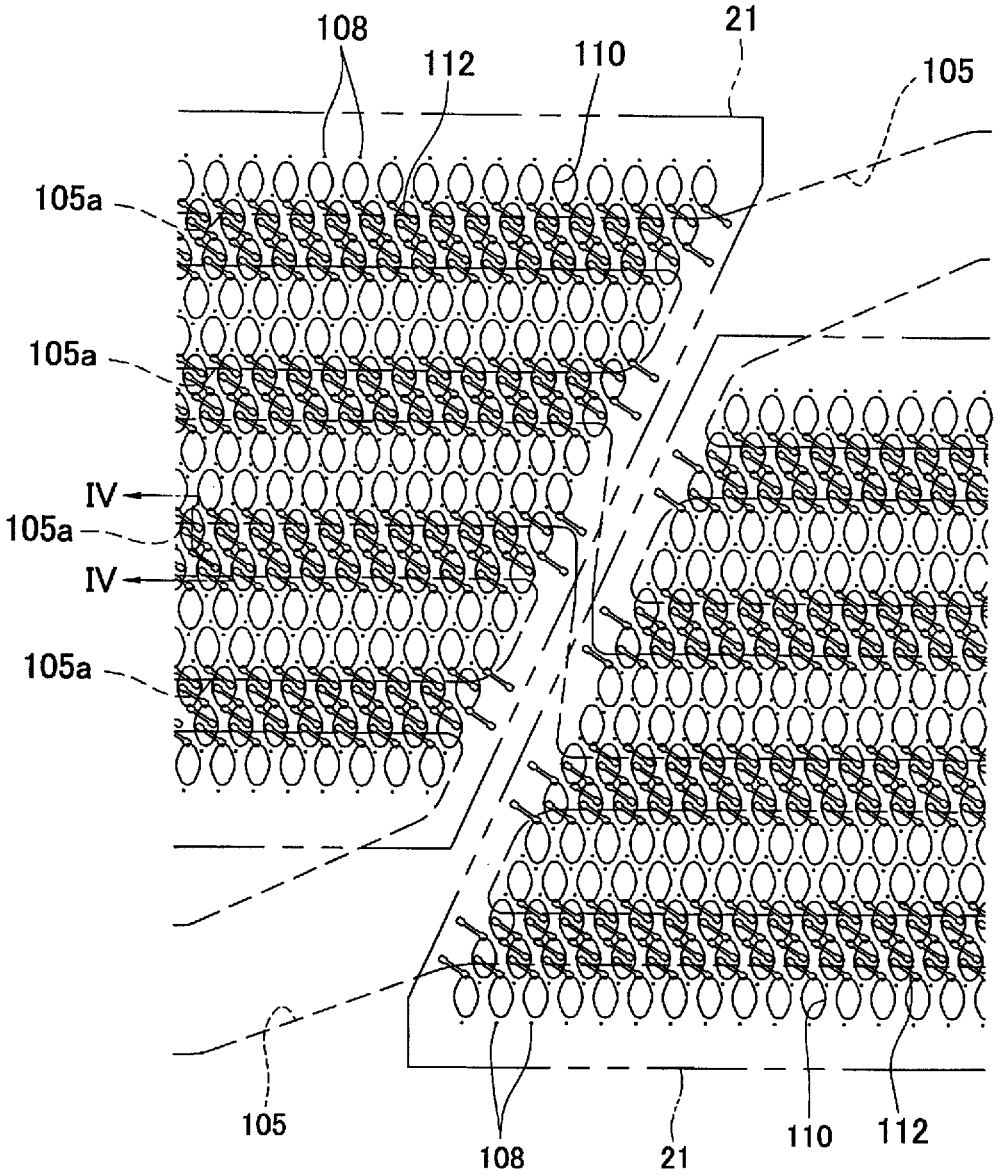
FIG. 3 is an enlarged view showing an area surrounded by a dashed-dotted line of FIG. 2.

As shown in FIG. 2, the head body 3 is a laminated body having the four actuator units 21 fixed on an upper surface of the flow path unit 9. A lower surface of the flow path unit 9 is the ejection surface 2*a*. An ink flow path is formed in the flow path unit 9, and the actuator units 21 apply ejection energy to the ink in the ink flow path.

Figure 4:
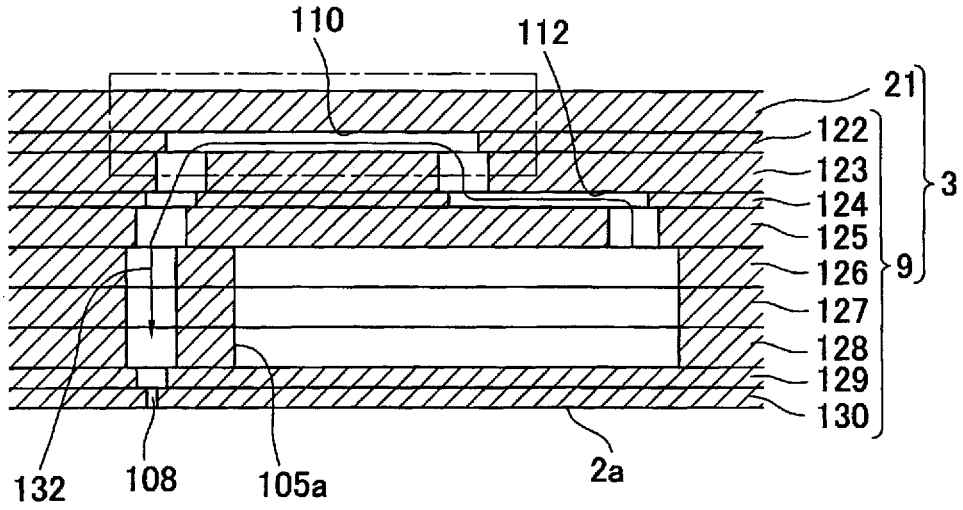
FIG. 4 is a partial sectional view taken along a line IV-IV of FIG. 3.

As shown in FIG. 4, the flow path unit 9 is a laminated body in which 9 metal plates 122 to 130 made of a stainless material are laminated. As shown in FIG. 2, ten (10) ink supply ports 105*b* which communicate with the reservoir unit are opened on the upper surface of the flow path unit 9. As shown in FIGS. 2 to 4, the flow path unit 9 is formed therein with manifold flow paths 105 having the ink supply ports 105*b* as one ends and a plurality of sub-manifold flow paths 105*a* which are branched from each of the manifold flow paths 105. Also, a plurality of individual ink flow paths 132 is formed, each of which is formed from an exit port of each sub-manifold flow path 105*a* to the ejection port 108 via the pressure chamber 110. The plurality of ejection ports 108 formed on the ejection surface 2*a* is arrayed in a matrix shape and are arranged at an interval of 600 dpi corresponding to a resolution with respect to the main scanning direction (in one direction).

As shown in FIGS. 2 to 4, the ink supplied from the reservoir unit to the ink supply port 105*b* is introduced into the manifold flow path 105 (sub-manifold flow paths 105*a*). The inks in the sub-manifold flow paths 105*a* are distributed into the respective individual ink flow paths 132 and reach the ejection ports 108 via the apertures 112 and the pressure chambers 110.

In the below, the actuator unit 21 is described. As shown in FIG. 2, the four actuator units 21 have a trapezoid shape, respectively, and are arranged in a zigzag shape in the main scanning direction so as to avoid the ink supply ports 105*b*. Also, parallel facing sides of each actuator unit 21 are arranged along the main scanning direction, and inclined sides of the actuator units 21 adjacent to each other overlap with each other in the sub-scanning direction.

Figure 5:
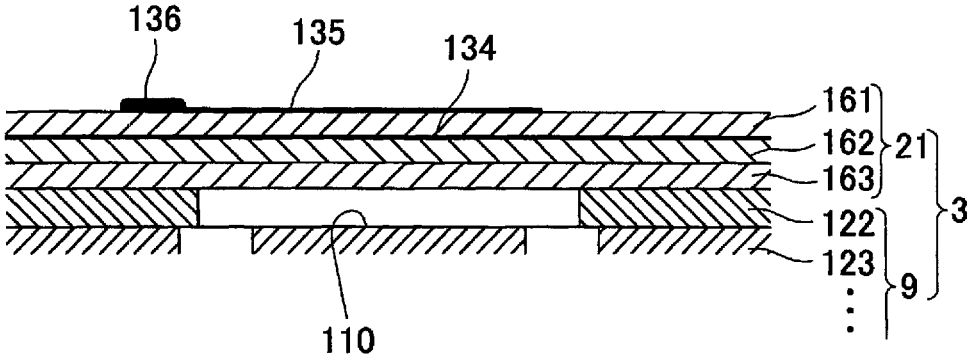
FIG. 5 is an enlarged view showing an area surrounded by a dashed-dotted line of FIG. 4.

As shown in FIG. 5, the actuator unit 21 is a piezo-type actuator having three piezoelectric layers 161 to 163 made of piezoelectric zirconate titanate (PZT) ceramics having ferroelectricity. The uppermost piezoelectric layer 161 is polarized in a thickness direction. Also, an upper surface of the piezoelectric layer 161 is formed with a plurality of individual electrodes 135. The individual electrodes 135 face the pressure chambers 110. A tip end of the individual electrode 135 is formed with an individual land 136. A common electrode 134 is interposed between the piezoelectric layer 161 and the lower piezoelectric layer 162 over an entire interface therebetween. In the meantime, areas of the common electrode 134, which correspond to all the pressure chambers 110, are equally applied with a ground potential. In the meantime, the individual electrodes 135 are selectively supplied with a driving signal via the individual lands 136.

When the individual electrode 135 is different in electric potential from the common electrode 134, a part positioned between the individual electrode 135 and the pressure chamber 110 is deformed with respect to the pressure chamber 110. That is, the part corresponding to the individual electrode 135 functions as an individual actuator (which is a part of the discharge unit). That is, the actuators corresponding to the number of the pressure chambers 110 are incorporated into the actuator unit 21, and the actuators selectively apply the ejection energy to the inks in the pressure chambers 110, respectively.

Here, a method of driving the actuator unit 21 is described. The actuator unit 21 is a so-called unimorph type actuator in which the one upper piezoelectric layer 161 spaced from the pressure chambers 110 is a layer including a driving activating part (a part positioned between both electrodes 134, 135) and the two lower piezoelectric layers 162, 163 close to the pressure chamber 110 are non-activating layers. For example, when the polarization direction and the applying direction of the electric field are the same, the driving activating part is contracted in a direction (plane direction) orthogonal to the polarization direction. At this time, since a difference of distortions in the plane direction is caused with respect to the lower piezoelectric layers 162, 163, the entirety of the piezoelectric layers 161 to 163 (the individual actuator) is convexly deformed (unimorph-deformed) toward the pressure chamber 110. Thereby, the pressure (ejection energy) is applied to the inks in the pressure chambers 110, so that the ink droplets are ejected from the ejection ports 108.

Meanwhile, in this illustrative embodiment, the individual electrodes 135 are beforehand applied with a predetermined potential. As the driving signal is supplied to the individual electrodes, the individual electrodes become once the ground potential and then return to the predetermined potential at a predetermined timing thereafter. At a timing when the individual electrodes 135 become the ground potential, the piezoelectric layers 161 to 163 return to the original states thereof and volumes of the pressure chambers 110 are increased. As a result, the inks are suctioned from the sub-manifold flow paths 105*a* to the individual ink flow paths 132. Also, at a timing when the predetermined potential is again applied to the individual electrodes 135, the individual actuator parts of the piezoelectric layers 161 to 163 are convexly deformed toward the pressure chambers 110 and the volumes of the pressure chambers 110 are decreased (the pressure of ink is increased). As a result, the ink droplets are ejected from the ejection ports 108.

Figure 7:
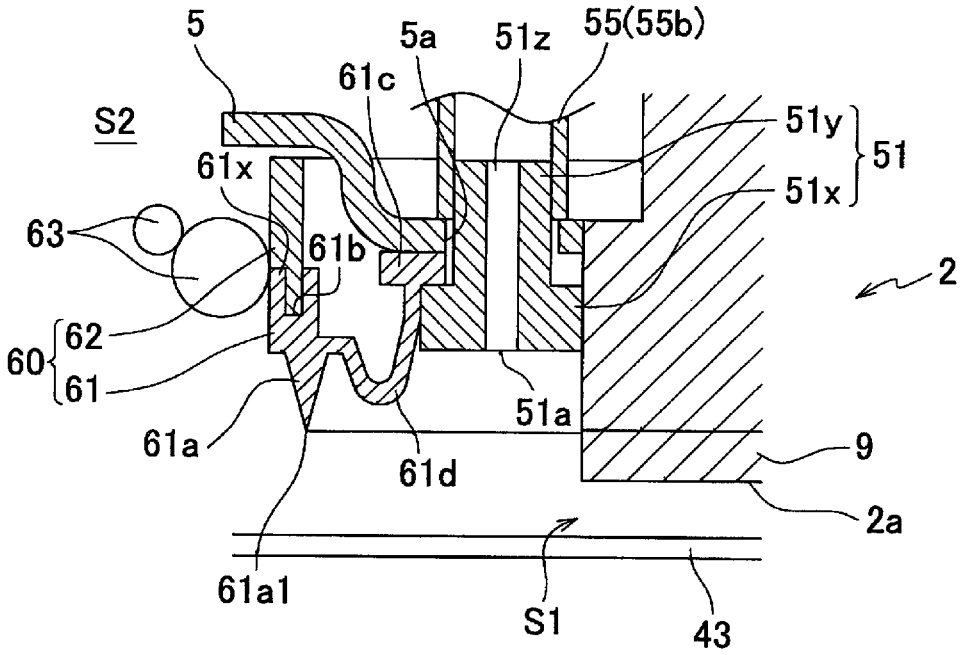
FIG. 7 is a partial sectional view showing an area surrounded by a dashed-dotted line of FIG. 6 when a cap is located at a remote position.

In the below, configurations of the head holder 5 and the cap unit attached thereto are described with reference to FIGS. 6 and 7.

The head holder 5 is a frame made of metal and the like and supports the side faces of the heads 2 over the entire peripheries thereof. The caps 60 and a pair of joints 51 are attached to the head holder 5. The caps 60 and the joints 51 are components of configuring the humidified air supply mechanism 50. The caps 60 form the closed ejection space S1 and the air in the space is replaced with the humidified air through the joints 51. Here, contact parts between the head holder 5 and the heads 2 are sealed with a sealant over the entire peripheries thereof. Also, contact parts between the head holder 5 and the caps 60 are fixed with an adhesive over the entire peripheries thereof.

The pair of joints 51 are inlet and outlet of the humidified air to and from the ejection space S1. As shown in FIG. 6, the pair of joints 51 include a left joint 51 having a supply port 51*a* and a right joint 51 having a discharge port 51*b*, and the head 2 is arranged therebetween in the main scanning direction. In the humidifying maintenance, the humidified air is supplied from the supply port 51*a* to the ejection space S1 and the air is discharged from the discharge port 51*b*.

The joint 51 has a square-shaped base end portion 51*x* and a cylindrical tip end portion 51*y* extending from the base end portion 51*x*. The base end portion 51*x* has a larger external dimension than the tip end portion 51*y*. The base end portion 51*x* has a longitudinal direction in the sub-scanning direction and a width (length) of the longitudinal direction is the substantially same as the ejection surface 2*a*. As shown in FIG. 7, the joint 51 is formed with a hollow space 51*z* which extends from the base end portion 51*x* to the tip end portion 51*y* along the vertical direction. The hollow space 51*z* is a cylindrical space in the tip end portion 51*y* and is a fan-shaped space in the base end portion 51*x*, which is enlarged toward the supply port 51*a*. The supply port 51*a* is long in the sub-scanning direction.

The head holder 5 is formed with a circular through-hole 5*a* and the joint 51 is fixed to the head holder 5 with the tip end portion 51*y* being inserted into the through-hole 5*a*. The tip end portion 51*y* is smaller than the through-hole 5*a* and a gap therebetween is filled with a sealant and the like and is thus sealed.

The cap 60 is a rectangular annular member which surrounds the outer periphery of the head 2, when seen from a plan view. As shown in FIG. 7, the cap 60 includes an elastic member 61 which is supported to the head holder 5 and a moveable member 62 which can be lifted up and down.

The elastic member 61 is made of an elastic material such as rubber and surrounds the head 2, when seen from a plan view. As shown in FIG. 7, the elastic member 61 has a base part 61*x*, a protrusion part 61*a* which protrudes from a lower surface of the base part 61*x*, a fixed part 61*c* which is fixed to the head holder 5 and a connection part 61*d* which connects the base part 61*x* and the fixed part 61*c*. The protrusion part 61*a* has a triangular section. Also, the fixed part 61*c* has a T-shaped section. An upper end of the fixed part 61*c* is fixed to the head holder 5 by the adhesive and the like. The fixed part 61*c* is also held by the head holder 5 and the base end portion 51*x* of each joint 51. The connection part 61*d* extends from a lower end of the fixed part 61*c* in an outward direction (a direction separating away from the ejection surface 2*a*, when seen from a plan view) with being bent, and connects with a lower and side surface of the base part 61*x*. The connection part 61*d* is deformed as the moveable member 62 is lifted up and down. A recess part 61*b* is formed in an upper surface of the base part 61*x* and a lower end of the moveable member 62 is fitted in the recess part 61*b*.

The moveable member 62 is made of an annular steel material (for example, stainless steel) and surrounds the outer periphery of the head 2, when seen from a plan view. The moveable member 62 is supported to the elastic member 61 and can be relatively moved to the head holder 5 in the vertical direction. The moveable member 62 is connected to a plurality of gears 63. When the lifting motor 64 (refer to FIG. 8) is driven under control of the control unit 100, the gears 63 are rotated to lift the moveable member 62 up and down. At this time, the base part 61*x* is also lifted up and down. Thereby, a relative position between a tip end 61*a*1 of the protrusion part 61*a* and the ejection surface 2*a* is changed in the vertical direction. In this illustrative embodiment, the driving force of the one lifting motor 64 is selectively transferred to the gears 63 for each cap 60.

The protrusion part 61*a* takes a contact position (a position shown in FIG. 6) at which the tip end 61*a*1 contacts the outer periphery of the conveyance belt 43 and a remote position (a position shown in FIG. 7) which is separated from the outer periphery, as the moveable member 62 is lifted up and down. At the contact position, the ejection space S1 is isolated and sealed from the exterior space S2. Also, at the remote position, the ejection space S1 is opened and thus not sealed with respect to the exterior space S2. The cap 60, the transfer mechanism including the gears 63, the head holder 5, the lifting motor 64 and the conveyance belt 43 configure the cap unit.

In the below, the configuration of the humidified air supply mechanism 50 is described with reference to FIG. 6.

As shown in FIG. 6, the humidified air supply mechanism 50 includes the pair of joints 51, tubes 55, 57, a pump 56, a tank 54 and the like. The tube 55 has a main part 55*a* common to the four heads 2 and four branch parts 55*b* branched from the main part 56*a*. The branch parts 55*b* are respectively connected to the joint 51. The pump 56 is provided to the main part 55*a*. The tube 57 also has a main part 57*a* common to the four heads 2 and four branch parts 57*b*, likewise the tube 55. The branch parts 57*b* are also connected to the joint 51, respectively. In FIG. 6, a connection state between one set of branch parts 55*b*, 57*b* and one head 2 is shown. Actually, the four heads 2 are connected in parallel with the one main part 55*a*, 57*a* via the branch parts 55*b*, 57*b*, respectively.

One end of the tube 55 (a tip end of the branch part 55*b*) is fitted in the tip end portion 51*y* of the left joint 51 and the other end thereof is connected to the tank 54. In the meantime, one end of the tube 57 (a tip end of the branch part 57*b*) is fitted in the tip end portion 51*y* of the right joint 51 and the other end thereof is connected to the tank 54. That is, the tubes 55, 57 enable the ejection space S1 and the tank 54 to communicate with each other. Here, the humidified air can be circulated by the pump 56 at a state where the caps 60 are sealed.

The tank (an example of a storing part) 54 stores the water (humidifying liquid) in a lower space thereof and stores the humidified air in an upper space, which is humidified by the water in the lower space. Also, the tank 54 is formed on its upper wall with an atmosphere communication hole 53 which enables the interior of the tank 54 and the atmosphere to communicate with each other. The tube 57 communicates with the lower space (water) of the tank 54. On the other hand, the tube 55 communicates with the upper space of the tank 54. In the meantime, a check valve (not shown) is attached to the tube 57 such that the water in the tank 54 does not flow into the tube 57, and the air is enabled to flow only along an arrow of FIG. 6.

A side wall of the tank 54 is provided with a sensor 66. The sensor 66 is provided at a height level flush with a connection port of the tube 57 and detects whether the water is stored in the tank 54. A detection signal thereof is output to the control unit 100. For example, when the water level in the tank 54 is flush with the connection port or lower, the sensor 66 detects that no water is stored. When the water level is above the connection port, the sensor 66 detects that water is stored. When no water is stored, the viscosity of the ink may be increased due to the circulating air. Therefore, the control unit 100 prohibits the viscosity increase preventing operation for ink (the driving of the pump 56). When water is stored, the air can be humidified. Therefore, the control unit 100 executes the viscosity increase preventing operation.

In the above configuration, when the humidifying maintenance which is the viscosity increase preventing operation is executed, the pump 56 is driven under control of the control unit 100 and the air in the tank 54 is circulated along the arrow as shown in FIG. 6. The humidified air in the upper space is supplied from the supply port 51*a* to the ejection space S1. At this time, since the ejection space S1 is sealed, the interior air flows toward the discharge port 51*b* while it is replaced with the humidified air. Since the tube 57 communicates with the water in the tank 54, the air in the ejection space S1 is humidified by the tank 54. The generated humidified air is supplied to the ejection space S1 while the pump 56 keeps driving.

Figure 8:
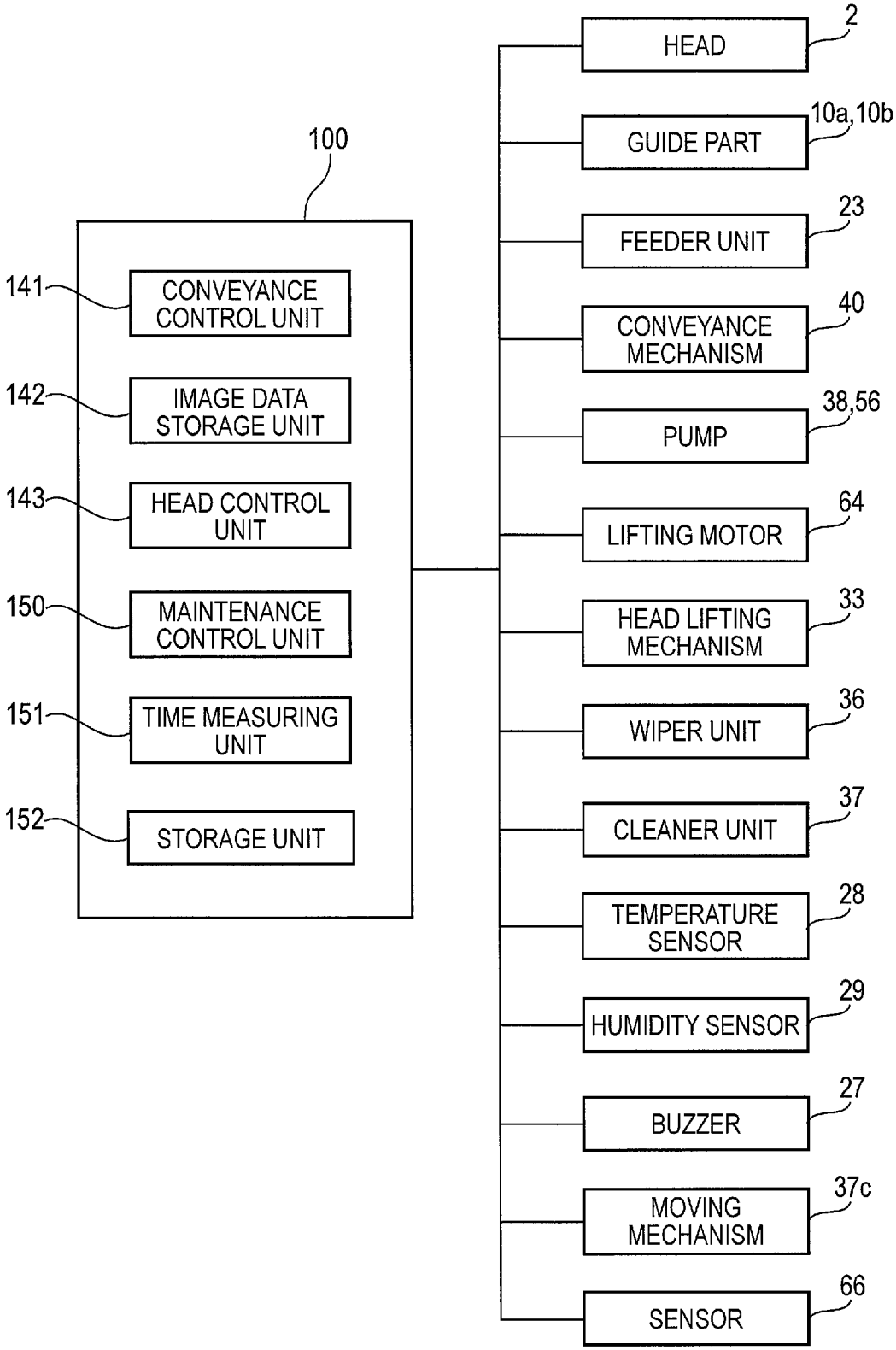
FIG. 8 is a functional block diagram of a control unit shown in FIG. 1.

In the below, the control unit 100 is described with reference to FIG. 8. The control unit 100 includes a CPU (Central Processing Unit), a ROM (Read Only Memory) which rewritably stores programs which are executed by the CPU and data which is used in the programs, and a RAM (Random Access Memory) which temporarily stores data at the execution time of the programs. The respective functional units configuring the control unit 100 are realized by the above hardware and software in the ROM. As shown in FIG. 8, the control unit 100 has a conveyance control unit 141, an image data storage unit 142, a head control unit 143, a maintenance control unit 150, a time measuring unit 151 and a storage unit 152.

The conveyance control unit 141 controls the respective operations of the feeder unit 23, the guide parts 10*a*, 10*b* and the conveyance mechanism 40 such that a sheet P is conveyed at predetermined speed in the conveyance direction based on a printing command received from an external apparatus. The image data storage unit 142 stores image data which is included in the printing command received from the external apparatus. The head control unit 143 controls the heads 2 such that an image relating to the image data stored in the image data storage unit 142 is printed on the sheet P conveyed to the conveyance mechanism 40, and such that the flushing operation is performed.

The time measuring unit 151 measures an end point of time of events by the respective control units, a time period between the respective points of time, and the like. The events include, for example, the printing based on the image data, the capping by the cap unit, the humidifying maintenance by the humidified air supply mechanism, the printing command reception by the control unit 100 and the like. The time period between the points of time to be measured includes a standby time. The standby time is time period from the end time of the humidifying maintenance to the receiving time of the printing command. However, when no water is stored in the tank 54, the standby time is time period from a point of time at which the maintenance control unit 150 prohibits the humidifying operation to the receiving time of the printing command.

The storage unit 152 stores, as an initial state, basic data of the flushing operation (basic flushing data). In this illustrative embodiment, the flushing operation includes the non-discharge flushing and the discharge flushing. The basic data includes information about the number of times of driving of the actuator in the non-discharge flushing and the discharge flushing. The number of times of driving is common to all the actuators. The flushing data can be rewritten and can be returned to the initial state, as required.

The maintenance control unit 150 controls the lifting motor 64 which lifts the moveable member 62 (tip end 61*a*1 of the protrusion part 61*a*) up and down and the pump 56 of the humidified air supply mechanism 50 when performing the viscosity increase preventing operation by the capping and humidifying maintenance. At this time, the maintenance control unit 150 performs predetermined humidifying maintenance when the sensor 66 detects that the water is stored in the tank 54. On the other hand, when the sensor 66 detects that no water is stored in the tank 54, the maintenance control unit 150 prohibits the humidifying operation (that is, the maintenance control unit does not drive the pump 56). In the meantime, the sensor 66 detects whether the water is stored in the tank during the capping. Also, the detection is performed at least one time before the humidifying maintenance.

When the sensor 66 detects that the water is stored in the tank 54 after the humidifying maintenance ends and until the printing command is received, the maintenance control unit 150 repeats the humidifying maintenance every predetermined time. At this time, when the sensor 66 detects that no water is stored in the tank 54, the maintenance control unit 150 prohibits the humidifying operation.

When executing the printing, the maintenance control unit 150 controls the actuators via the head control unit 143 such that the flushing operation is performed when the sensor 66 detects that the water is stored in the tank 54. When the standby time is second predetermined time or shorter, the maintenance control unit 150 performs the control of performing the flushing operation even though the sensor 66 detects that no water is stored in the tank 54. The flushing operation is a preparation operation for the printing and is performed based on the flushing data stored in the storage unit 152. Regarding the flushing operation of this illustrative embodiment, the capping is released after the non-discharge flushing and then the discharge flushing is performed. That is, when the printing command is received, the non-discharge flushing is performed at the capping state and then the release of the capping and the discharge flushing to the conveyance belt 43 are performed successively. At this time, an ink discharge amount by the discharge flushing is different according to the detection results of the sensor 66. When the sensor 66 detects that no water is stored in the tank 54, the maintenance control unit 150 increases the ink discharge amount, compared to a case where the sensor 66 detects that water is stored in the tank 54. Specifically, the maintenance control unit 150 increases the number of times of discharge of the ink droplets in the discharge flushing. At this time, the flushing data of the storage unit 152 is rewritten by the maintenance control unit 150. For example, compared to a case where the water is stored in the tank 54 (flushing data of the initial state), an increase in the number of times of discharge of 1,000 times is instructed. In a modified illustrative embodiment, the amount of droplets by one discharge may be increased. In this case, the ink discharge amount is increased even though the number of times of discharge is the same.

Also, in another modified illustrative embodiment, regarding the flushing operation, the non-discharge flushing and the discharge flushing may be repeated after the discharge flushing of the above illustrative embodiment. In this case, the discharge of the ink having the increased viscosity by the discharge flushing and the stifling of the ink having the increased viscosity by the vibration of the non-discharge flushing are repeated more than once, so that it is possible to restore the liquid ejection capability from the ejection ports 108 still more efficiently.

Also, when executing the printing, the maintenance control unit 150 increases the ink discharge amount by the discharge flushing as the standby time becomes longer than a first predetermined time. The ink discharge amount is increased by increasing the number of times of discharge. At this time, the flushing data of the storage unit 152 is rewritten by the maintenance control unit 150. For example, the maintenance control unit 150 instructs addition of the number of times of 100 times whenever the standby time becomes longer than the first predetermined time by 10 minutes. On the other hand, when the standby time is the first predetermined time or shorter, the maintenance control unit 150 controls the driving of the actuators, based on the flushing data (including the non-discharge flushing data and the discharge flushing data) stored in the storage unit 152 at that time. For example, when the sensor 66 detects that the water is stored in the tank 54, the maintenance control unit 150 performs the control, based on the basic flushing data. When the sensor 66 detects that no water is stored in the tank 54, the maintenance control unit 150 performs the control, based on the flushing data having the discharge flushing data rewritten thereto. In a modified illustrative embodiment, the first predetermined time may be zero. In this case, the number of times of the liquid discharge in the discharge flushing is increased as time passes.

Also, when the sensor 66 detects that no water is stored in the tank 54 and the standby time becomes longer than the second predetermined time, the maintenance control unit 150 rewrites the flushing data, which is stored in the storage unit 152, by the data with which the purge operation is performed. After that, the maintenance control unit 150 controls the pumps 38, the head lifting mechanism 33 and the wiper unit 36 so as to perform the purge operation and the wiping operation, instead of the flushing operation, based on the data stored in the storage unit 152. In the meantime, the ink discharge amount by the purge operation is greatly larger than the ink discharge amount by the discharge flushing.

Also, as the temperature detected by the temperature sensor 28 becomes higher than a predetermined temperature, the maintenance control unit 150 increases the number of times of the liquid discharge such that the ink discharge amount by the discharge flushing is increased. At this time, the discharge flushing data stored in the storage unit 152 is rewritten by the maintenance control unit 150. For example, whenever the temperature is more increased by 1° C. than the predetermined temperature, the maintenance control unit 150 instructs the addition of the number of times of 100 times. In a modified illustrative embodiment, the predetermined temperature may be zero. In this case, as the temperature is increased, the number of times of the liquid discharge by the discharge flushing is increased.

Also, as the humidity detected by the humidity sensor 29 becomes lower than a predetermined humidity, the maintenance control unit 150 increases the number of times of the liquid discharge such that the ink discharge amount by the discharge flushing is increased. At this time, the discharge flushing data stored in the storage unit 152 is rewritten by the maintenance control unit 150. For example, whenever the humidity is more decreased by 5% than the predetermined humidity, the maintenance control unit 150 instructs the addition of the number of times of 100 times. In a modified illustrative embodiment, the predetermined humidity may be 100%. In this case, as the humidity is decreased, the number of times of the liquid discharge in the discharge flushing is increased.

Also, after performing the discharge flushing and the purge operation, the maintenance control unit 150 performs the cleaning operation for the conveyance belt 43. At this time, the maintenance control unit 150 controls the moving mechanism 37*c* so as to move the cleaning liquid applying member 37*a* and the blade 37*b* to the contact positions and controls the conveyance mechanism 40 so as to move the conveyance belt 43 in the clockwise direction via the conveyance control unit 141. Thereby, the cleaning liquid is applied to the outer periphery of the conveyance belt 43 and the ink on the outer periphery is thus scraped by the blade 37*b* together with the cleaning liquid.

Figures 9, 9A, 9B:
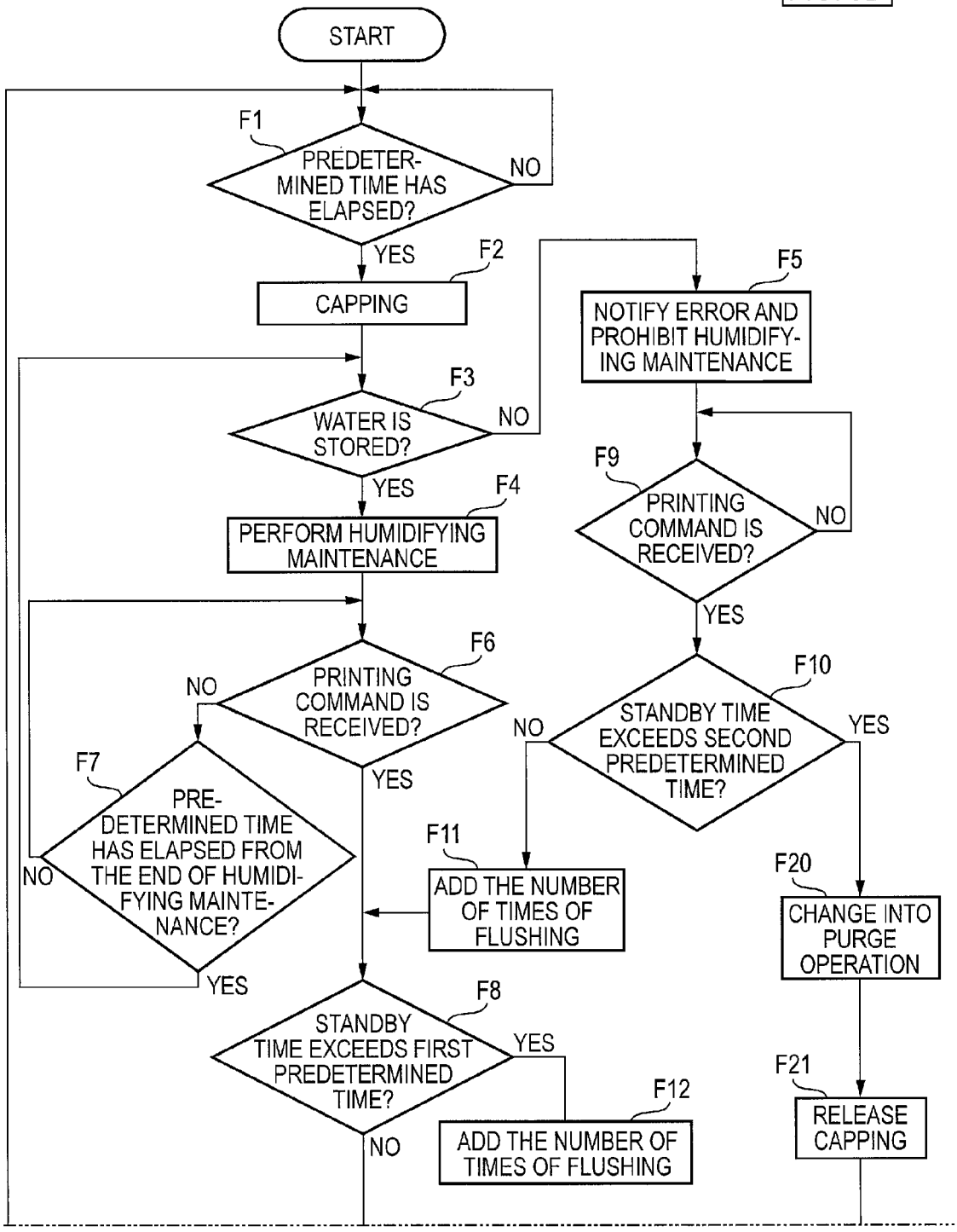
FIG. 9 (FIGS. 9A and 9B) is a flowchart showing an operation flow relating to a maintenance operation which is executed by the control unit of the printer of FIG. 1.
Figure 9B:
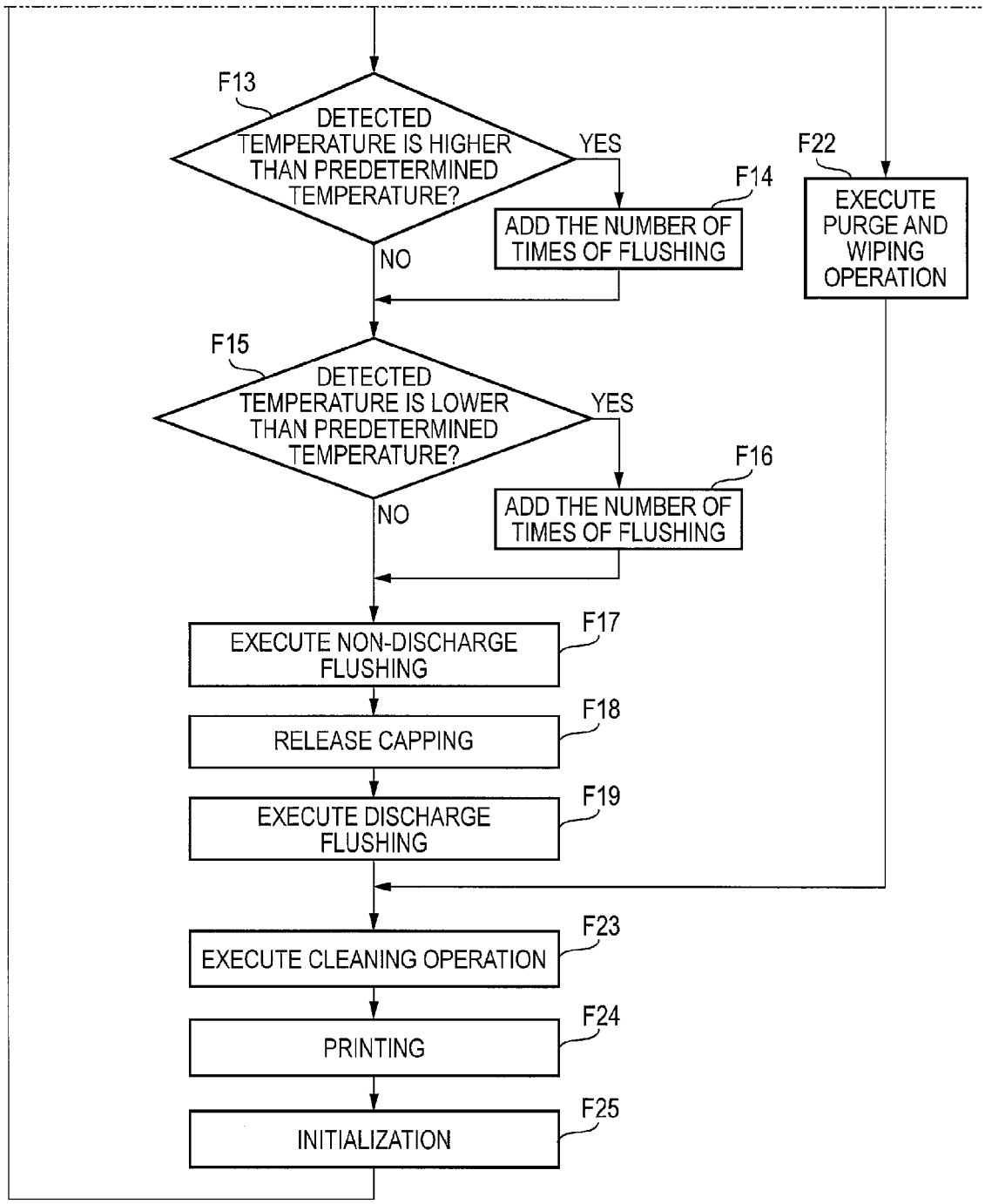

In the below, an operation flow of the printer 1 relating to the maintenance operation is described with reference to FIG. 9. In the meantime, a state at the start time of the operation flow in FIG. 9 is a standby state after a printing operation ends. From the end of the printing operation, the time measuring unit 151 measures time.

First, the control unit 100 determines whether a predetermined time has elapsed after the previous printing ends, based on the measuring result by the time measuring unit 151 (F1). When it is determined that the predetermined time has not elapsed, the process returns to step F1. In the meantime, when a printing command is received from the external apparatus before the predetermined time elapses, the printing based on the printing command is performed by the conveyance control unit 141 and the head control unit 143.

On the other hand, when it is determined that the predetermined time has elapsed, the maintenance control unit 150 controls the lifting motor 64 to cap the ejection surfaces 2*a* (to seal the ejection space S1) (F2). Then, in step F3, the control unit 100 determines whether there is water stored in the tank 54, from the output of the sensor 66. When water is stored 54, the process proceeds to step F4, and when no water is stored, the process proceeds to step F5.

In step F4, the maintenance control unit 150 drives the pump 56, thereby performing the humidifying maintenance for a predetermined time. Thereby, the ejection space S1 is filled with the humidified air, so that the drying of the ink adjacent to the ejection ports 108 is suppressed. After that, the process proceeds to step F6.

In step F6, the control unit 100 determines whether a printing command is received. When a printing command is received, the process proceeds to step F8, and when a printing command is not received, the process proceeds to step F7. In step F7, the control unit 100 determines whether a predetermined time has elapsed after the humidifying maintenance ends. When the predetermined time has not elapsed, the process returns to step F6, and when the predetermined time has elapsed, the process returns to step F3. At the returned step F3, when the control unit 100 determines that there is water stored, the process proceeds to step F3, as described above, and the humidifying maintenance is again performed.

In step F5, the control unit 100 controls the buzzer 27 to generate a sound for notifying the user that there is no water stored (error notification) and the maintenance control unit 150 prohibits the humidifying maintenance. Thereby, it is possible to notify the user that there is no water (humidifying liquid) stored.

Then, in step F9, the control unit 100 determines whether a printing command is received. The control unit 100 continues this determination until a printing command is received. When a printing command is received, the process proceeds to step F10. In step F10, the control unit 100 determines whether the standby time exceeds the second predetermined time, from the measuring result of the time measuring unit 151. At this time, the standby time is time from the prohibiting time (step F5) of the humidifying maintenance to the receiving time of the printing command (step F9).

Here, when the standby time is the second predetermined time or shorter, the process proceeds to step F11. In step F11, the maintenance control unit 150 rewrites the flushing data stored in the storage unit 152. For example, the number of times of discharge in the discharge flushing is increased by 1,000 times. After the process of adding the number of times of discharge, the process proceeds to step F8. On the other hand, when the standby time exceeds the second predetermined time, the process proceeds to step F20.

In step F8, the control unit 100 determines whether the standby time exceeds the first predetermined time shorter than the second predetermined time. When the standby time exceeds the first predetermined time, the process proceeds to step F12, and when the standby time is the first predetermined time or shorter, the process proceeds to step F13. In step F12, the maintenance control unit 150 rewrites the flushing data of the storage unit 152 such that as the standby time becomes longer than the first predetermined time, the number of times of liquid discharge by the discharge flushing is increased. For example, whenever the standby time becomes longer than the first predetermined time by 10 minutes, 100 times is added to the current number of times of discharge. Then, the process proceeds to step F13.

In step F13, the control unit 100 determines whether the temperature detected by the temperature sensor 28 is higher than a predetermined temperature. When the temperature is higher than the predetermined temperature, the control unit proceeds to step F14, and when the temperature is the predetermined temperature or lower, the process proceeds to step F15. In step F14, the maintenance control unit 150 rewrites the flushing data of the storage unit 152 such that as the detected temperature becomes higher than the predetermined temperature, the number of times of liquid discharge by the discharge flushing is increased. For example, whenever the temperature is increased by 1° C., 100 times is added to the current number of times of discharge. Then, the control unit proceeds to step F15.

In step F15, the control unit 100 determines whether the humidity detected by the humidity sensor 29 is lower than the predetermined humidity. When the humidity is lower than the predetermined humidity, the process proceeds to step F16, and when the humidity is the predetermined humidity or higher, the process proceeds to step F17. In step F16, the maintenance control unit 150 rewrites the flushing data of the storage unit 152 such that as the detected humidity becomes lower than the predetermined humidity, the number of times of liquid discharge by the discharge flushing is increased. For example, whenever the humidity is decreased by 5%, 100 times is added to the current number of times of discharge. Then, the process proceeds to step F17.

In step F17, the maintenance control unit 150 controls the actuators of the heads 2 to execute the non-discharge flushing. Then, in step F18, the maintenance control unit 150 controls the lifting motor 64 to release the capping and to unseal the ejection space S1. At this time, the non-discharge flushing is continuously performed.

Then, in step F19, the maintenance control unit 150 performs the discharge flushing operation, based on the flushing data stored in the storage unit 152. That is, when it is determined in step F3 that water is stored in the tank 54 and when it is determined in step F10 that the standby time is the second predetermined time or shorter, the maintenance control unit 150 controls the actuators of the heads 2 to discharge ink droplets from the respective ejection ports 108 onto the conveyance belts 43 by the set number of times of discharge (discharge flushing).

Then, in step F20, the maintenance control unit 150 rewrites the flushing data of the storage unit 152 with the data with which the purge operation is performed so as to perform the purge operation, instead of the discharge flushing. Then, the process proceeds to step F21.

Then, in step F21, similarly to step F18, the maintenance control unit 150 controls the lifting motor 64 to release the capping and to unseal the ejection space S1. After that, in step F22, the maintenance control unit 150 performs the pressurization purge operation and the wiping operation. That is, the maintenance control unit 150 controls the pumps 38 to forcibly discharge the inks from all the ejection ports 108 (purge operation). In a modified illustrative embodiment, the ejection surface 2*a* may be covered with a cap member having a recess shape to seal the ejection space S1 and the pressure in the ejection space S1 may be made to be a negative pressure lower than a resistance pressure to the ink menisci formed in the ejection ports 108. Accordingly, it is possible to suction and purge the inks in the ejection ports 108.

As shown in FIG. 10A, the maintenance control unit 150 performs the purge operation and then controls the head lifting mechanism 33, thereby moving the four heads 2 from the printing position to the retraction position. After that, as shown in FIG. 10B, the maintenance control unit 150 controls the wiper unit 36 to wipes the ejection surfaces 2*a* by the wipers 36*a* (wiping operation), respectively. Then, when the wiping operation ends, the maintenance control unit 150 controls the head lifting mechanism 33 to return the four heads 2 to the printing position.

Then, in step F23, the maintenance control unit 150 controls the moving mechanism 37*c* to move the cleaning liquid applying member 37*a* and the blade 37*b* to the contact position and controls the conveyance mechanism 40 via the conveyance control unit 141 to move the conveyance belt 43 in the clockwise direction. Thereby, the cleaning liquid is applied on the outer periphery of the conveyance belt 43 and the ink on the outer periphery is thus scraped by the blade 37*b* together with the cleaning liquid (cleaning operation).

Then, in step F24, the printing based on the printing command received in steps F6 and F9 is performed by the conveyance control unit 141 and the head control unit 143. Then, in step F25, the control unit 100 initializes the data stored in the storage unit 152 (the storage unit is returned to the initial state). Then, the process returns to the processing of step F1.

As described above, according to the printer 1 of this illustrative embodiment, when no water (humidifying liquid) is stored in the tank 54, since the ink discharge amount in the discharge flushing from the ejection ports 108 is larger than that of a case where the water is stored in the tank, it is possible to effectively discharge the ink having the increased viscosity in the vicinity of the ejection ports 108. Therefore, it is possible to restore the liquid ejection capability from the ejection ports 108. Hence, it is possible to keep the quality of the image formed based on the printing command. In addition, while the water in the tank 54 is exhausted and thus the user supplies the tank 54 with water (when the humidifying maintenance becomes possible), it is possible to restore the liquid ejection capability from the ejection ports 108 and to thus keep the quality of the image formed by the heads 2.

Also, when the water in the tank 54 is exhausted before performing the humidifying maintenance, the humidifying maintenance is prohibited. Thereby, the air that is not humidified is not supplied into the ejection space S1 under sealed state, so that the drying of the ink in the vicinity of the ejection ports does not advance.

Also, as the standby time becomes longer than the first predetermined time, the ink discharge amount by the discharge flushing is increased. Therefore, even when the standby time is prolonged, it is possible to restore the liquid ejection capability from the ejection ports 108 more effectively.

Also, as the temperature becomes higher than the predetermined temperature, the ink discharge amount by the discharge flushing is increased. Therefore, even when the temperature is increased, it is possible to restore the liquid ejection capability from the ejection ports 108 more effectively.

Also, as the humidity becomes lower than the predetermined humidity, the ink discharge amount by the discharge flushing is increased. Therefore, even when the humidity is decreased, it is possible to restore the liquid ejection capability from the ejection ports 108 more effectively.

Also, in the flushing operation, since the non-discharge flushing is performed before the discharge flushing, it is possible to restore the liquid ejection capability from the ejection ports 108 more effectively.

When no water is stored in the tank 54 and the standby time exceeds the second predetermined time, the purge operation is performed instead of the discharge flushing. Therefore, even when the ink in the vicinity of the ejection ports 108 has been dried, it is possible to surely restore the liquid ejection capability from the ejection ports 108 by the purge operation.

While the present invention has been shown and described with reference to certain illustrative embodiments thereof, it will be understood by those skilled in the art that various changes in form and details may be made therein without departing from the spirit and scope of the invention as defined by the appended claims.

For example, in the above illustrative embodiment, when the water in the tank 54 is exhausted, the ink discharge amount in the discharge flushing becomes larger than that of a case where the water is stored in the tank. However, when no water is stored in the tank, the purge operation may be performed instead of the discharge flushing, irrespective of the standby time. In this case, since the ink discharge amount in the purge operation is much larger than that in the discharge flushing, it is possible to effectively discharge the ink having the increased viscosity in the vicinity of the ejection ports 108. Hence, the same effects as the above can be realized. Also, even when the standby time exceeds the second predetermined time, the purge operation may not be performed instead of the discharge flushing. Also, the non-discharge flushing may not be performed. Also, the temperature and humidity sensors 28, 29 may not be provided. In this case, the control is simple.

In the above illustrative embodiment, regarding the second predetermined time, the start time of the time measurement is the prohibiting time of the humidifying maintenance (step F5). However, when it is determined that there is no water stored after the previous printing ends, the start time of the time measurement may be the end time of the capping by the cap unit (step F2).

Also, regarding the cap unit capable of sealing and unsealing the ejection space S1, the cap unit may include a cap which has a bottom part facing the ejection surface 2*a* and an annular part to stand upright at a periphery edge of the bottom part and a moving mechanism which moves the cap to a position at which a tip end of the annular part contacts the ejection surface 2*a* and a position which is spaced from the ejection surface 2*a*. In this case, a supply port through which the humidified air is supplied and a discharge port may be provided to the bottom part of the cap.

The inventive concept of the present invention can be applied to any of the line type and the serial type inkjet printer. Also, the inventive concept can be applied to a facsimile, a copier and the like as well as the printer. Also, the inventive concept can be applied to a recording apparatus which performs recording by ejecting liquid, other than the ink. The recording medium is not limited to the sheet P and various recordable media may be used. Further, the inventive concept can be applied irrespective of the ink ejection method. For example, in this illustrative embodiment, the piezoelectric element has been used. However, a resistance heating method, an electrostatic capacity method can be also used.

What is claimed is:

1. A liquid ejection apparatus comprising:

a liquid ejection head which includes ejection ports for ejecting liquid;

a cap unit which is configured to take a sealed state where an ejection space facing the ejection ports is sealed from an exterior space and a non-sealed state where the ejection space is opened to the exterior space;

a humidified air supply mechanism which includes a storing part configured to store humidifying liquid for generating humidified air, and which is configured to perform a humidifying operation of generating humidified air and supplying the humidified air into the ejection space at the sealed state;

a discharge unit which is configured to discharge liquid from the ejection ports;

a control unit which is configured to control the humidified air supply mechanism to perform the humidifying operation after controlling the cap unit to take the sealed state, and which is configured to control the discharge unit to perform a liquid discharge operation of discharging liquid from the ejection ports after controlling the cap unit to take the non-sealed state in response to receiving a printing command at a standby state after the humidifying operation; and a detection unit which is configured to detect whether the humidifying liquid is stored in the storing part, wherein after the cap unit takes the sealed state and until the humidified air supply mechanism starts the humidifying operation, when the detection unit detects that no humidifying liquid is stored in the storing part, the control unit is configured to control the discharge unit such that a liquid discharge amount from the ejection ports in the liquid discharge operation is larger than that of a case where the detection unit detects that the humidifying liquid is stored in the storing part, and wherein after the cap unit takes the sealed state and until the humidified air supply mechanism starts the humidifying operation, when the detection unit detects that no humidifying liquid is stored in the storing part, the control unit is configured to control the humidified air supply mechanism to prohibit the humidifying operation.

2. The liquid ejection apparatus according to claim 1, wherein the discharge unit includes an actuator which is configured to apply a pressure to liquid in the liquid ejection head to discharge liquid droplets from the ejection ports, and wherein the control unit is configured to control the actuator to perform a discharge flushing of discharging liquid droplets from the ejection ports as the liquid discharge operation.

3. The liquid ejection apparatus according to claim 2, further comprising:

a measuring unit which is configured to measure a time period of the standby state until the printing command is received, wherein the control unit is configured to control the actuator such that as the time period measured by the measuring unit is longer, a liquid discharge amount in the discharge flushing is increased.

4. The liquid ejection apparatus according to claim 2, further comprising:

a humidity detection unit which is configured to detect a humidity in a surrounding of the liquid ejection head, wherein the control unit is configured to control the actuator such that as the humidity detected by the humidity detection unit is lower, a liquid discharge amount in the discharge flushing is increased.

5. The liquid ejection apparatus according to claim 2, further comprising:

a temperature detection unit which is configured to detect a temperature in a surrounding of the liquid ejection head, wherein the control unit is configured to control the actuator such that as the temperature detected by the temperature detection unit is higher, a liquid discharge amount in the discharge flushing is increased.

6. The liquid ejection apparatus according to claim 2, wherein the control unit is configured to control the actuator to perform a non-discharge flushing of vibrating liquid menisci formed in the ejection ports without discharging the liquid from the ejection ports after the printing command is received and until the discharge flushing is performed.

7. The liquid ejection apparatus according to claim 6, wherein the control unit is configured to control the actuator such that the non-discharging flushing and the discharge flushing are alternately performed.

8. The liquid ejection apparatus according to claim 1, further comprising:

a notifying unit which is configured to notify a user that no humidifying liquid is stored in the storing part when the detection unit detects that no humidifying liquid is stored in the storing part.

9. A liquid ejection apparatus comprising:

a liquid ejection head which includes ejection ports for ejecting liquid;

a cap unit which is configured to take a sealed state where an ejection space facing the ejection ports is sealed from an exterior space and a non-sealed state where the ejection space is opened to the exterior space;

a humidified air supply mechanism which includes a storing part configured to store humidifying liquid for generating humidified air, and which is configured to perform a humidifying operation of generating humidified air and supplying the humidified air into the ejection space at the sealed state;

a discharge unit which is configured to discharge liquid from the ejection ports, the discharge unit comprising:

an actuator which is configured to apply a pressure to liquid in the liquid ejection head to discharge liquid droplets from the ejection ports, and, a forcible discharge unit which is configured to perform a purge operation of forcibly discharging liquid from the ejection ports by causing liquid to flow into the liquid ejection head or suctioning liquid in the ejection ports;

a control unit which is configured to control the humidified air supply mechanism to perform the humidifying operation after controlling the cap unit to take the sealed state, and which is configured to control the discharge unit to perform a liquid discharge operation of discharging liquid from the ejection ports after controlling the cap unit to take the non-sealed state in response to receiving a printing command at a standby state after the humidifying operation;

a detection unit which is configured to detect whether the humidifying liquid is stored in the storing part; and a measuring unit which is configured to measure a time period of the standby state until the printing command is received, wherein after the cap unit takes the sealed state and until the humidified air supply mechanism starts the humidifying operation, when the detection unit detects that no humidifying liquid is stored in the storing part, the control unit is configured to control the discharge unit such that a liquid discharge amount from the ejection ports in the liquid discharge operation is larger than that of a case where the detection unit detects that the humidifying liquid is stored in the storing part, wherein the control unit is configured to control the actuator to perform a discharge flushing of discharging liquid droplets from the ejection ports as the liquid discharge operation, and wherein after the cap unit takes the sealed state and until the humidified air supply mechanism starts the humidifying operation, when the detection unit detects that no humidifying liquid is stored in the storing part, the control unit is configured to control the actuator to perform the discharge flushing if the time period measured by the measuring unit is a predetermined time period or shorter, and control the forcible discharge unit to perform the purge operation if the time period measured by the measuring unit exceeds the predetermined time period.

* * * * *